US009185503B2

(12) United States Patent
Lamba

(10) Patent No.: US 9,185,503 B2
(45) Date of Patent: Nov. 10, 2015

(54) DOMES FOR A RECEIVER-IN-THE-CANAL HEARING INSTRUMENT

(75) Inventor: Lavlesh Lamba, Piscataway, NJ (US)

(73) Assignee: Sivantos Pte. Ltd., Singapore (SG)

( * ) Notice: Subject to any disclaimer, the term of this patent is extended or adjusted under 35 U.S.C. 154(b) by 998 days.

(21) Appl. No.: 12/465,696

(22) Filed: May 14, 2009

(65) Prior Publication Data

US 2010/0290656 A1 Nov. 18, 2010

(51) Int. Cl.
*H04R 25/00* (2006.01)

(52) U.S. Cl.
CPC ..... *H04R 25/652* (2013.01); *H04R 25/604* (2013.01); *H04R 25/65* (2013.01); *H04R 25/658* (2013.01); *H04R 2225/021* (2013.01)

(58) Field of Classification Search
CPC ..... H04R 25/65; H04R 25/652
USPC ..... 381/312, 322, 324, 328, 330
See application file for complete search history.

(56) References Cited

U.S. PATENT DOCUMENTS

| | | | | |
|---|---|---|---|---|
| 4,073,366 | A | 2/1978 | Estes | |
| 5,694,475 | A | 12/1997 | Boyden | |
| 7,110,562 | B1 | 9/2006 | Feeley et al. | |
| 7,141,014 | B2 | 11/2006 | Saltykov | |
| 7,627,131 | B2 * | 12/2009 | Nielsen et al. | 381/328 |
| 2002/0196958 | A1 * | 12/2002 | Halteren et al. | 381/328 |
| 2006/0050914 | A1 * | 3/2006 | Urso et al. | 381/328 |
| 2009/0116672 | A1 | 5/2009 | Prahl et al. | |

FOREIGN PATENT DOCUMENTS

| | | | |
|---|---|---|---|
| JP | S62 151100 | A | 7/1987 |
| WO | 2007/100336 | A1 | 9/2007 |
| WO | 2008/095489 | A1 | 8/2008 |

OTHER PUBLICATIONS

European Search Report of European Patent Application No. EP 10 15 4278 dated May 7, 2013.

* cited by examiner

*Primary Examiner* — Matthew E Warren
(74) *Attorney, Agent, or Firm* — Laurence A. Greenberg; Werner H. Stemer; Ralph E. Locher

(57) ABSTRACT

A receiver for a receiver-in-the-canal hearing instrument can be securely held by a dome comprising a receiver receptacle that selectively receives and holds the receiver. After the dome has been assembled, pulling on the electrical cable connected to the receiver will not dislodge the receiver from the dome.

12 Claims, 3 Drawing Sheets

DOMES FOR A RECEIVER-IN-THE-CANAL HEARING INSTRUMENT

BACKGROUND AND SUMMARY OF THE INVENTION

A receiver-in-the-canal hearing instrument comprises a receiver inserted into the ear canal, an electronics module, comprising a microphone, amplifier, and battery, and an interconnecting electrical cable. The receiver is held in a dome.

To remove the receiver from the canal, users typically pull on the electrical cable, occasionally dislodging the receiver from the dome. To prevent this from happening, a receptacle that securely holds the receiver is created within the dome.

DESCRIPTION OF THE INVENTION

Figure 1:
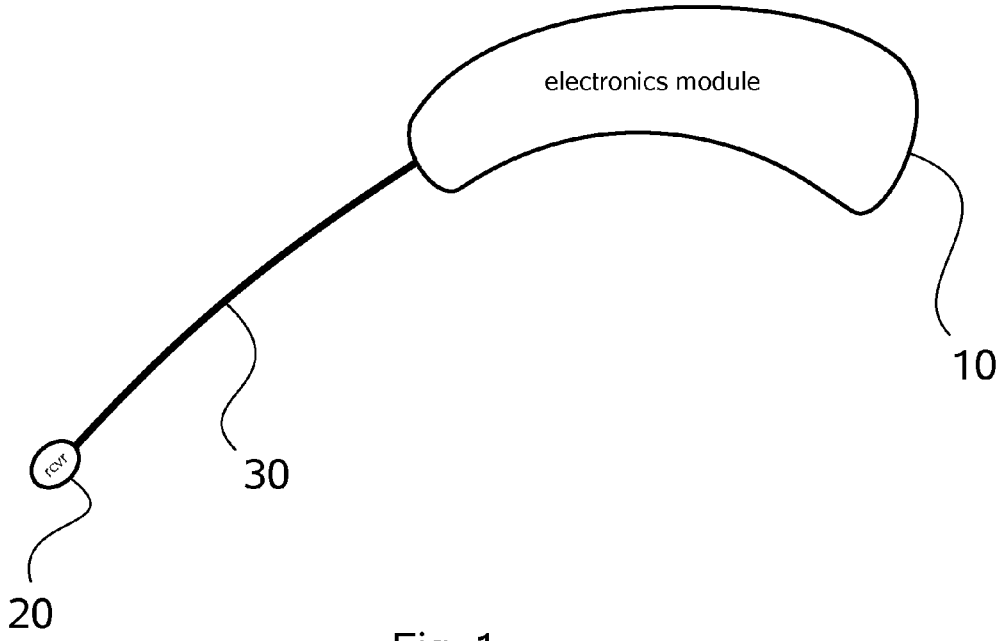
FIG. 1 is a drawing of a receiver-in-the-canal hearing instrument, comprising a receiver, an electronics module, and an interconnecting electrical cable.
Figure 2:
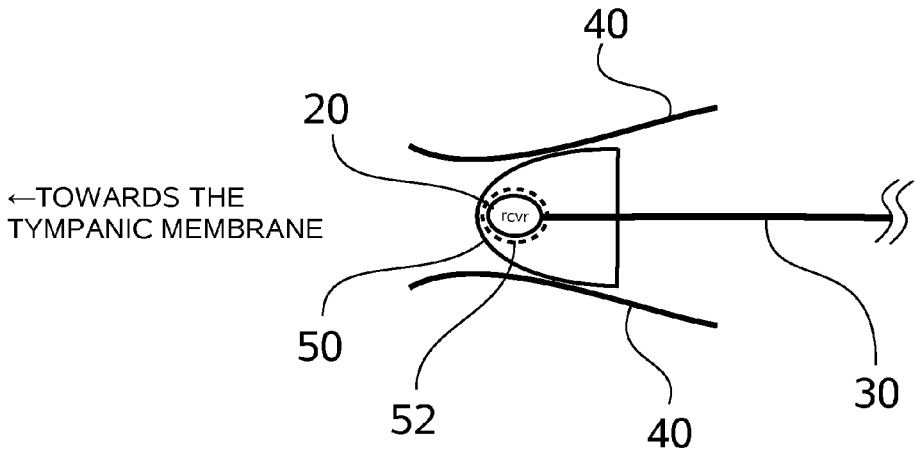
FIG. 2 is a schematic drawing of a dome with a receptacle for the receiver of FIG. 1 and the interconnecting electrical cable.

A receiver-in-the-canal hearing instrument, comprising an electronics module 10, a receiver 20 (without a dome), and an interconnecting electrical cable 30, is shown in FIG. 1. The electronics module 10 may be configured as a behind-the-ear device, a helix-type device (for the helix of the ear), or any other suitable arrangement. A schematic representation of a dome 50 residing adjacent the walls 40 of the ear canal and holding the receiver 20 within a receptacle 52 is shown in FIG. 2.

Figure 3:
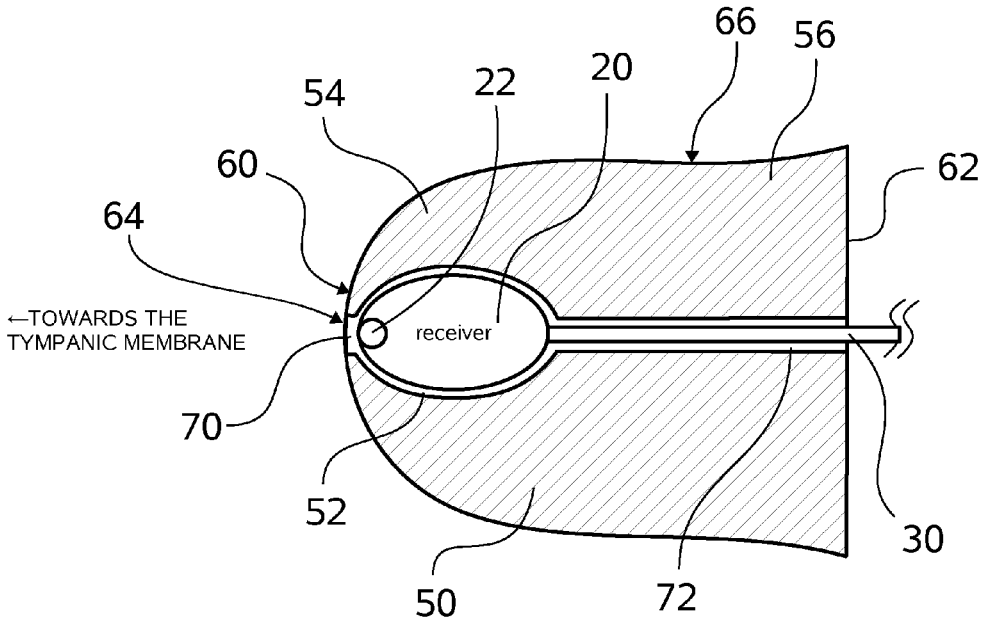
FIG. 3 is a partial cross-sectional view of the dome of FIG. 2.

The receiver 20 and cable 30 are shown again in a conforming receptacle 52 in a dome 50 in the partial cross-sectional view of FIG. 3, the dome 50 comprising an anterior portion 54 and a posterior portion 56. The dome 50 also comprises a dome-shaped tip 60 and a posterior face 62. In this figure, the receptacle 52 is located within the anterior portion 54 of the dome 50, although it could be located elsewhere in the dome 50, such as the geometric center 58 of the dome 50 (determined, e.g., as a function of length and diameter), as depicted schematically by the crossed, dashed lines. The size and shape of the receptacle 52 may be selected to conform to the size and shape of the receiver 20, such that the latter is held securely. The outer surface 66 of the dome 50 is selected to conform to at least a portion of the user's ear canal walls 40.

A receiver outlet channel 70, allowing the sound from the outlet 22 (depicted schematically) of the receiver 20 to travel to the tympanic membrane, is located in the anterior portion 54 of the dome 50. The receiver outlet channel 70 connects the receptacle 52 to the opening 64 in the tip 60 of the dome 50.

An electrical cable channel 72 is located in the posterior portion 56 of the dome 50, connecting the receptacle 52 with the posterior face 62 of the dome 50. The electrical cable channel 72 provides a pathway for the interconnecting electrical cable 30 attached to the receiver 20. The diameter or width 74 of the electrical cable channel 72 is selected to conform to or accommodate the outer diameter or width 32 of the electrical cable 30, but is shown much larger in the figures for clarity of presentation (see FIG. 4 for elements 32 and 74, indicated by the opposing arrows). As possible design choices, the diameter or width 74 of the electrical cable channel 72 may be approximately equal to or slightly larger than the outer diameter or width 32 of the electrical cable 30.

Figure 4:
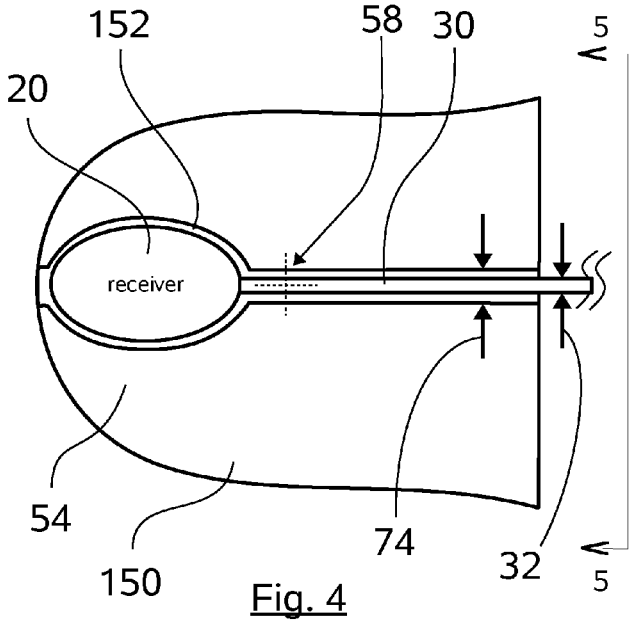
FIGS. 4 and 5 are elevation and end views of one-half of a dome.
Figure 5:
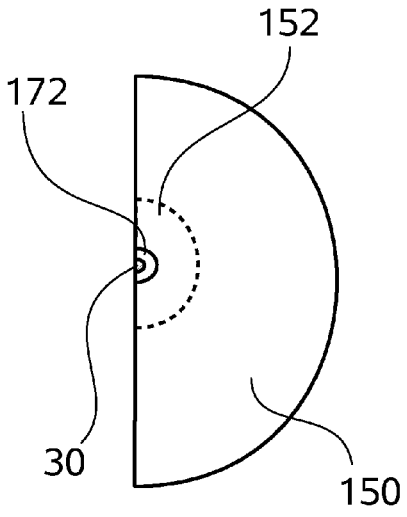

The dome 50 may be constructed in two complementary halves 150 (or unequal, but complementary, portions), each comprising a receptacle portion 152 and an electrical cable channel portion 172, as illustrated by the elevation and end views of FIGS. 4 and 5, respectively, showing one half 150 of the dome 50. After the receiver 20 is placed in the receptacle portion 152, the two halves 150 are brought together and secured. Any known technique may be utilized to insure proper registration and securement of the two halves 150.

Figure 6:
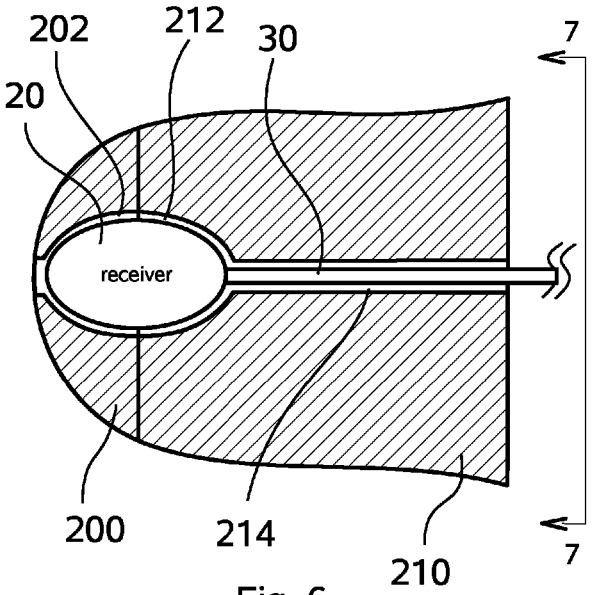
FIGS. 6 and 7 are cross-sectional and end views of a dome comprising anterior tip and posterior sections.
Figure 7:
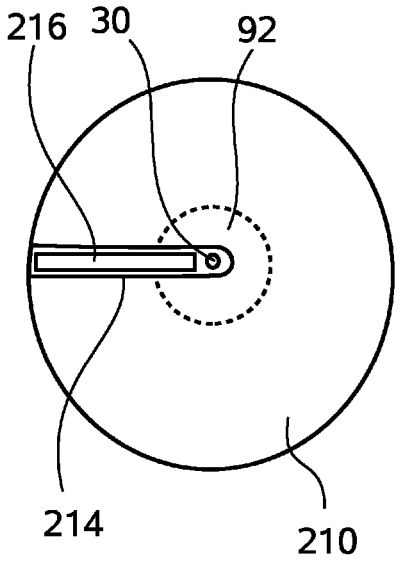
Figure 8:
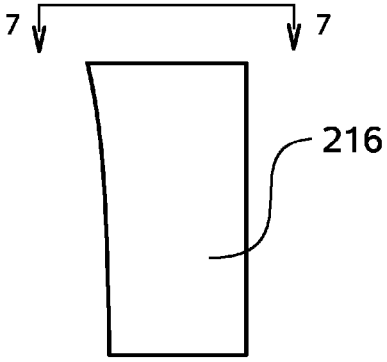
FIG. 8 is a drawing of a closure element for the posterior section of FIGS. 6 and 7.

As an alternative to the two halves 150, the dome 50 may be fashioned as an anterior tip section 200 and a posterior section 210, shown in FIGS. 6 and 7. To assemble the dome, the receiver 20 is placed first in a receptacle portion 212 in the posterior section 210, while the interconnecting electrical cable 30 is inserted into a slot 214. The anterior tip section 200 is then placed over the receiver 20, securing it in place. Again, any known technique may be utilized to insure proper registration and securement of the anterior tip and a posterior sections 200 and 210. The slot 214 may be closed by inserting a removable closure element 216, illustrated in FIGS. 7 and 8.

Figure 9:
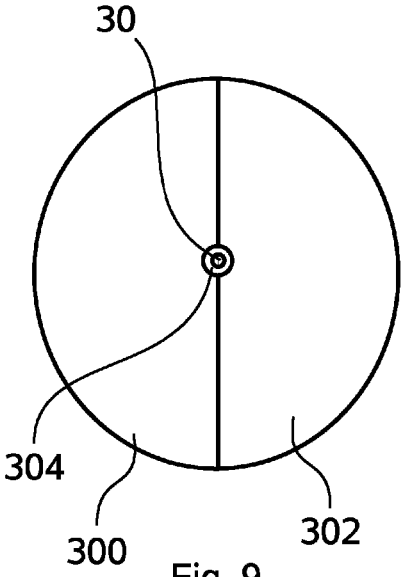
FIG. 9 is an end view of the posterior section of FIGS. 6 and 7, where the posterior section is subdivided into complementary halves.

As yet a further alternative to the configuration of FIGS. 6 and 7, the posterior section 210 could be divided into two complementary halves 300 and 302, shown in FIG. 9, obviating the need for the slot 214. Instead, a channel 304 (comprising two complementary channel portions) would be provided to accommodate and hold the interconnecting electrical cable 30.

If desired, the dome 50 may be fabricated utilizing known techniques for sizing, modeling, and fabricating the outer surfaces of a hearing instrument shell, such as described in U.S. Patent Application Publication No. 2002/0196954 A1, published Dec. 26, 2002 and titled, "Modeling and fabrication of three-dimensional irregular surfaces for hearing instruments," incorporated here by reference. Further, the dome 50 may be fabricated using materials that result in hardness ratings ranging from 50 on the Shore A scale to 80-85 on the Shore D scale. A commercially-available apparatus that may be employed for fabrication of the dome 50 is the Connex500 printing system manufactured by Objet Geometries Ltd., Rehovot, Israel.

What is claimed is:

1. An ear-canal dome for receiving and retaining an in-the-canal hearing instrument receiver and an electrical connecting cable connected to the receiver and an electronics module, for insertion into the ear canal of the user, the dome comprising:

an outer surface conforming to at least a portion of the user's ear canal;

an anterior portion comprising a dome-shaped tip oriented towards the inner ear, the tip comprising a dome-tip opening;

a posterior portion comprising a posterior surface oriented towards the outer ear, the posterior surface comprising an opening;

a receptacle for selectively receiving and retaining the receiver, where the receptacle conforms to the outer contour of the receiver;

a first channel connecting the receptacle to the dome-tip opening in the dome-shaped tip;

a second channel connecting the receptacle and the opening in the posterior surface, the second channel selectively receiving and retaining the electrical connecting cable;

each of said first channel and said second channel having a smaller diameter than the receptacle; and the dome being constructed from two separate, complementary halves assembled together, with each half including a portion of the receptacle and a portion of the second channel.

2. An ear-canal dome as set forth in claim 1, wherein the diameter or width of the second channel is approximately equal to the diameter or width of the outer surface of the electrical connecting cable.

3. An ear-canal dome as set forth in claim 1, wherein the receptacle is positioned in the anterior portion of the dome.

4. An ear-canal dome as set forth in claim 1, wherein the dome comprises an anterior dome-shaped tip section and posterior section.

5. A receiver-in-the canal hearing instrument, comprising:

an in-the-canal hearing instrument receiver;

an electrical connecting cable connecting the receiver to an electronics module; and the ear-canal dome as set forth in claim 1.

6. An ear-canal dome for receiving and retaining an in-the-canal hearing instrument receiver and an electrical connecting cable connected to the receiver and an electronics module, for insertion into the ear canal of the user, the dome comprising:

an outer surface conforming to at least a portion of the user's ear canal;

an anterior portion comprising a dome-shaped tip oriented towards the inner ear, the tip comprising a dome-tip opening;

a posterior portion comprising a posterior surface oriented towards the outer ear, the posterior surface comprising an opening;

a receptacle for selectively receiving and retaining the receiver, where the receptacle conforms to the outer contour of the receiver;

a first channel connecting the receptacle to the dome-tip opening in the dome-shaped tip;

a second channel connecting the receptacle and the opening in the posterior surface, the second channel selectively receiving and retaining the electrical connecting cable;

each of said first channel and said second channel having a smaller diameter than the receptacle; and the dome being constructed from an anterior tip section and a separate posterior section assembled together, the posterior section including a slot for inserting an electrical cable into the second channel.

7. An ear-canal dome as set forth in claim 6, wherein the diameter or width of the second channel is approximately equal to the diameter or width of the outer surface of the electrical connecting cable.

8. An ear-canal dome as set forth in claim 6, wherein the receptacle is positioned in the anterior portion of the dome.

9. An ear-canal dome as set forth in claim 6, wherein the anterior tip section and the posterior section are two complementary portions.

10. An ear-canal dome as set forth in claim 9, wherein the two complementary portions are complementary halves.

11. An ear-canal dome as set forth in claim 6, further comprising an electronics module.

12. A receiver-in-the canal hearing instrument, comprising:

an in-the-canal hearing instrument receiver;

an electrical connecting cable connecting the receiver to an electronics module; and the ear-canal dome as set forth in claim 6.

* * * * *